United States Patent [19]

Allen

[11] Patent Number: 4,730,392

[45] Date of Patent: Mar. 15, 1988

[54] HYDRAULIC PUNCH TOOL FOR HEAT EXCHANGERS

[75] Inventor: Jackie C. Allen, Pascagoula, Miss.

[73] Assignee: Chevron Research Company, San Francisco, Calif.

[21] Appl. No.: 816,100

[22] Filed: Jan. 3, 1986

Related U.S. Application Data

[63] Continuation of Ser. No. 635,965, Jul. 31, 1984, Pat. No. 4,597,180.

[51] Int. Cl.[4] ..... B23D 21/06; B26B 27/00

[52] U.S. Cl. ..... 30/106; 30/92

[58] Field of Search ..... 30/92, 105, 106, 358, 30/360, 361, 366

[56] References Cited

U.S. PATENT DOCUMENTS

| | | | |
|---|---|---|---|
| 3,568,657 | 3/1971 | Gue | 30/277 X |
| 4,424,629 | 1/1984 | Schott | 30/105 |
| 4,455,746 | 6/1984 | Idzik et al. | 30/106 |

*Primary Examiner*—Douglas Watts

*Attorney, Agent, or Firm*—Edward J. Keeling; V. A. Norviel; P. L. McGarrigle

[57] ABSTRACT

A punch tool is disclosed for puncturing the walls of heat exchanger tubes when they become worn in order that the tubes may be repaired. Said tool comprises a hardened, longitudinally drilled, steel rod that is able to fit within the heat exchanger tube. A piston with a cutting bit is fit within a milled slot that communicates with the longitudinally drilled hole of the hardened rod. Once the tool is inserted into a tube to be repaired hydraulic pressure is applied and the piston is forced outward thereby puncturing the tube.

2 Claims, 5 Drawing Figures

HYDRAULIC PUNCH TOOL FOR HEAT EXCHANGERS

This is a continuation of application Ser. No. 635,965, filed July 31,1984, now U.S. Pat. No. 4,597,180.

FIELD OF THE INVENTION

This device relates to tools employed for puncturing an aperture in a tube. More specifically, the tool is used to rupture heat exchanger tubes prior to plugging the tube ends.

BACKGROUND OF THE INVENTION

Repairs to a heat exchanger tube often require the plugging of the ends when part of the tube becomes corroded or begins to leak into the surrounding medium. However, before a tube end can be plugged, it is necessary to puncture or sever the body of the tube to prevent liquids from being trapped within the tube. If this is not done, there would be a subsequent pressure build-up inside the plugged tubes and eventually the plug would blow out.

Due to the nature of many types of heat exchangers, access to these tubes is usually restricted; consequently they must be cut from the inside. A common procedure for severing tubes to be plugged uses a mechanical fly cutter. This tool consists of a specially-designed pair of cutting bits enclosed within a cutter body. For normal cutting operations the tool is inserted into the tube to be cut, the cutter bits are extended from within the tool by a retractable mandrel, and then the bits are spun in a 360° circle by an air motor. When the bits are fully extended, the tube will be completely severed. Afterwards, the mandrel is retracted causing the bits to retract within the cutter body and as a result the tool may be removed.

There are several disadvantages to this procedure. Using the mechanical fly cutter is a slow and sometimes involved process that requires an air motor and an associated compressor. Additionally, once the tube has been severed, it is free to vibrate and damage the surrounding tubes which may, in turn, necessitate their repair as well. The remaining disadvantage of the device is that metal shavings and dirt enter the inside of the cutter body where the bits extend, causing these bits to lock in the extended position. Once this occurs, it is impossible to remove the cutter without damaging or breaking the bits; if so, then replacement is necessary. Other tools are also presently available for puncturing tubes to be plugged, but there are disadvantages to these tubes as well. They are mechanical and require a great deal of force to penetrate a heavy-walled tube, and when smaller tubes are to be punctured, the stresses involved can cause the tool to bend or break.

The present invention is unique in that it is lighter, involves fewer parts, has a lower cost, and punctures a hole that relieves the internal pressure of the tube without damaging any surrounding tubes.

SUMMARY OF THE INVENTION

The present invention relates to a hydraulic tool for puncturing heat exchanger tubes. The tool is inserted into the tube beyond the tube sheet, and hydraulic pressure is applied. This forces a hardened tool bit to puncture the tube wall. The tool is then removed, and the ends of the tube are plugged in the normal manner. The tool comprises a hollow cylindrical member having an open and a closed end with a slot positioned on the curved surface of the member near the closed end. A slidable piston is fit within the slot and a cutting point is attached at substantially right angles to the upper side of the piston. Once this member has been inserted into a heat exchanger tube a hydraulic means is applied so that the slidable piston is forced outwards whereby the cutting point is displaced from the inside of the hollow member part of the tool to a point beyond the outside diameter of the hollow member. This forces the cutting point to come in contact with the internal diameter of the tube and a puncture results.

The tool punctures a more precise hole and eliminates the need for severing the entire heat exchanger tube. When using this tool there is no possibility of having a loose, severed tube to cause damage to the surrounding tubes once it begins to vibrate. This tool also is superior to the current art because it is cheaper, lighter, easier and less dangerous to operate, has fewer parts, is more reliable and less prone to damage.

DETAILED DESCRIPTION OF THE INVENTION

Figure 5:
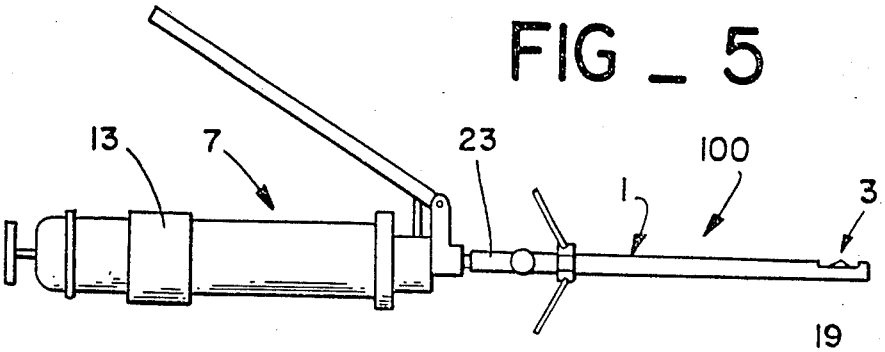
FIG. 5 is a side view showing the tool connected to the grease gun.
Figure 1:
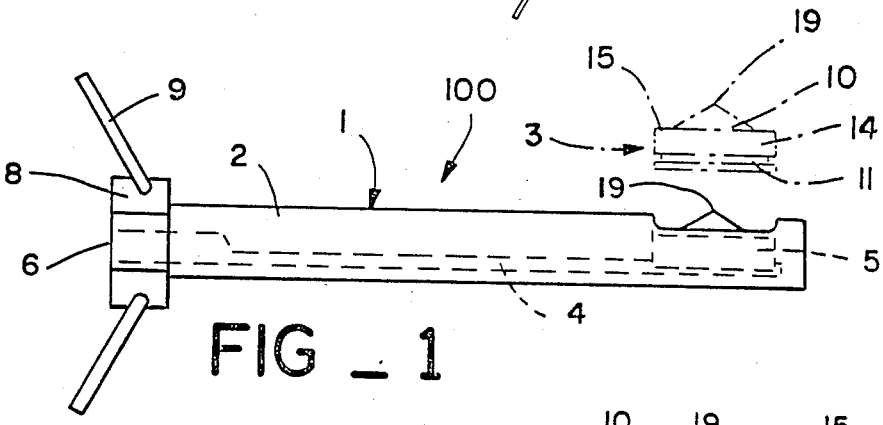
FIG. 1 is a side view of the entire tool with the piston in place and a figure in phantom of the piston as removed.

FIG. 1 is an illustration of the tool according to the present invention, which is generally referred to by reference numeral 100. It essentially consists of two parts 1 and 3 which are described below.

The first part 1 has a hardened steel rod 2 with a passage 4 longitudinally drilled to intersect the end of a milled slot 5 located at the opposite end of the rod 2. The open end 6 of the steel rod 2 with the drilled hole 4 is adapted to be connected to a standard grease gun 7 with an adaptor 23. Open end 6 has a retracting nut 8 with handles 9 to facilitate connection and removal.

In an embodiment for use in puncturing 0.750 inch, 13 to 16-gauge tubes, the outside diameter of the steel rod 2 is 0.590 inches. Although it is not necessary to use this size of tool 100 for this type of tube, the outside diameter of tool assembly 100 must be small enough to fit within a heat exchanger tube 12. However, the tool diameter must be large enough so that tool 100 will be forced against the inside of tube 12 once the piston 14 is extended and still have sufficient throw to allow the cutting bit 10 to puncture tube 12.

Figure 3:
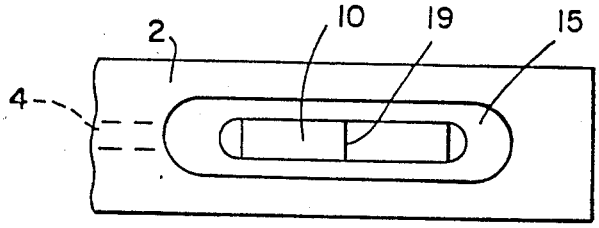
FIG. 3 is a top view of the piston in place with the cutting bit pointing upward.
Figure 2:
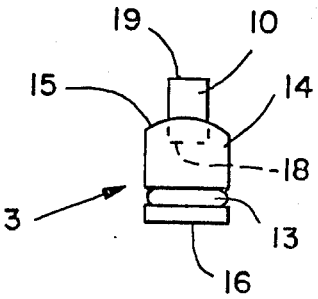
FIG. 2 is an end view of the piston and cutting bit assembly.
Figure 4:
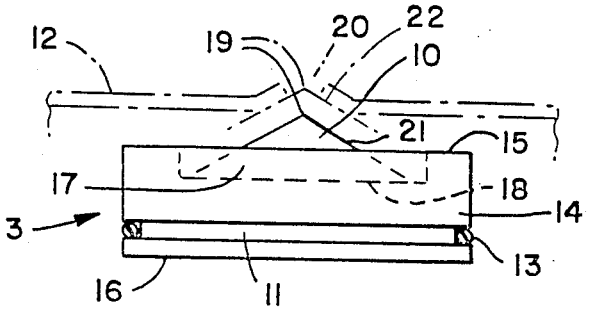
FIG. 4 is an enlarged view showing the cutting bit in operation where a tube has been punctured.

The second part 3 of tool 100 is a hardened steel piston 14 as shown in FIGS. 2–4. It is fitted with an O-ring seal 9 and a special cutting bit 10 fixed to the top 15 of piston 14. When used in the steel rod 2 for puncturing the 0.750 inch tubes described above, the piston 14 will have a generally rectangular shape, preferably with the dimensions 1 inch by 0.375 inches by 0.425 inches. However, as mentioned above, these dimensions are suggested and the size of the piston 14 may vary. The only requirements are, that when inserted into tube 12 the piston 14 be of sufficient height so that it may extend cutting bit 10 far enough to puncture the tube 12, but, low enough for cutting point 10 to fit within the tube 12 when the cutting point 10 is in the least extended position 21. The top 15 of the piston 14 is curved so that it may fit flush with the steel rod 2 when extended. The end of piston 14 near the flat lower surface 16 of the piston 14 has an O-ring groove 11 so that the O-ring may be properly fit within the piston 14 without any fluid leakage or loss in pressure. The cutting bit 10, being of generally triangular shape, has an overall height of 0.290 inches in the embodiment used for 0.750 inch tubes mentioned above. This too may vary in size, but should be high enough so that, in combination with the piston 14, the cutting bit 10 may puncture the tube 12. The broad base 17 of the cutting tool 10 is fitted into a groove 18 in the top surface 15 of the piston 14, with the base 17 of the cutting bit 10 essentially parallel to the bottom surface 16 of the piston 14 so that the sharp point 19 of the cutting tool 10 faces outward.

The complete tool 100 and the grease gun 7 are connected by an adaptor 23 and the tool 100 is inserted into the tube 12 to be punctured. The grease gun 7 used to create hydraulic pressure within 1 is a convenient source of pressure in this embodiment, but it must be remembered that many other devices may be used to achieve the same result. An example of the change in piston position is shown in FIG. 4 whereby hydraulic pressure is applied by the grease gun 7 to the lower surface 16 of the piston 14 which forces the piston 14 and cutting bit 10 outward from a lower position 21 to an extended position 22, thus causing the sharp point 19 of the cutting bit 10 to puncture the tube 12.

After a hole 20 has been punctured in the side of the tube 12, the whole tool assembly 100 may be removed using a slide knocker 13 mounted on the grease gun 7. The slide knocker 13 is a cylindrical weight attached to the body of the grease gun 7. It is used to create a sudden force on the object to which it is attached so that the object may be pulled in a specific direction. The slide knocker 13 may be used to retract the tool 100 by driving its weight in an opposing direction from that which the tool 100 was first inserted. This overcomes any resistance the lodged tool bit 10 would exert and the tool 100 may be easily removed from the punctured tube 12.

As mentioned before, the dimensions given for tool 100 are applicable to 0.750 inch, 13 to 16-gauge tubes 12, consequently, several different size rods 2 will be required to fit various tube diameters and wall thicknesses. However, the requirements that regulate the size of the tool and its pieces are governed by those factors discussed above such as tube diameters and wall thicknesses. For example, a larger diameter steel rod 2, and a taller piston 14 or cutting member 10 (or combination thereof) will be required for tubes 12 with larger internal diameters. Furthermore, an increase in height of the cutting bit or a sharper, more angular cutting point may be required for tubes 12 of greater thickness.

Although a specific embodiment of the invention has been described herein in detail, the invention is not to be limited to only such embodiment, but rather only by the appended claims.

What is claimed is:

1. A punch tool for puncturing a hole in a tube comprising:

a hollow cylindrical member having an open end, a closed end, and a central axis running the length of the cylindrical member;

a curved surface on said hollow member coaxial with said central axis, said curved surface surrounding a slot positioned to intersect said curved surface of the member at an angle perpendicular with the central axis and substantially near the closed end, whereby the slot communicates with the hollow portion of the cylindrical member;

a slidable piston fit within the slot, said piston having an upper and a lower side parallel to said central axis;

a cutting point attached to the slidable piston at substantially right angles to the upper side of the piston; and means for forcing the slidable piston radially, whereby the cutting point may be displaced from within the hollow member to a point beyond the outside diameter of the hollow member so that a puncture results in the tube in which the tool has been inserted wherein the means for forcing the slidable piston outward comprises a grease gun affixed to the aperture of the elongated, tubular member in such a manner so that a fluid tight fit is achieved between the member and the grease gun.

2. A punch tool for puncturing a hole in a tube comprising:

a hollow cylindrical member having an open end, a closed end, and a central axis running the length of the cylindrical member;

a curved surface on said hollow member coaxial with said central axis, said curved surface surrounding a slot positioned to intersect said curved surface of the member at an angle perpendicular with the central axis and substantially near the closed end, whereby the slot communicates with the hollow portion of the cylindrical member;

a slidable piston fit within the slot, said piston having an upper and a lower side parallel to said central axis;

said piston further comprising an upper and lower surface, the upper surface being partially rounded to conform to the outside surface of the elongated, tubular member and the lower surface providing a support for a sealing means;

a cutting point of substantially triangular shape wherein the base of the cutting point is affixed to the upper surface of the piston, the height of the cutting point will vary according to the thickness of the tube wall so that a hole will be punched in the tube wall; and means for forcing the slidable piston radially, whereby the cutting point may be displaced from within the hollow member to a point beyond the outside diaameter of the hollow member so that a puncture results in the tube in which the tool has been inserted.

* * * * *